United States Patent [19]

Zimmerman

[11] Patent Number: 4,738,617

[45] Date of Patent: Apr. 19, 1988

[54] RETORT FLUID DISTRIBUTOR

[75] Inventor: Robert V. Zimmerman, North Glenn, Colo.

[73] Assignee: Senca, Denver, Colo.

[21] Appl. No.: 934,862

[22] Filed: Nov. 25, 1986

[51] Int. Cl.[4] ..... F27D 1/08

[52] U.S. Cl. ..... 432/95; 431/170; 34/169

[58] Field of Search ..... 432/95, 215; 431/170; 34/168

[56] References Cited

U.S. PATENT DOCUMENTS

| | | | |
|---|---|---|---|
| 3,401,922 | 9/1968 | Jones, Jr. . | |
| 3,432,348 | 3/1969 | Jones, Jr. . | |
| 3,561,927 | 2/1971 | Jones, Jr. . | |
| 3,589,611 | 6/1971 | Jones, Jr. . | |
| 3,777,940 | 12/1973 | Jones, Jr. . | |
| 4,060,914 | 12/1977 | Hoffman | 98/40.19 |
| 4,116,779 | 9/1978 | Harris . | |
| 4,221,638 | 9/1980 | Jones, Jr. . | |
| 4,371,335 | 2/1983 | Jones | 432/95 |
| 4,402,665 | 9/1983 | Korenberg | 431/170 |
| 4,441,261 | 4/1984 | Beckmann | 34/169 |
| 4,545,959 | 10/1985 | Schilling et al. | 431/170 |

*Primary Examiner*—Henry C. Yuen

*Attorney, Agent, or Firm*—Sigalos & Levine

[57] ABSTRACT

The present invention relates to an improved method and system for properly and uniformly distributing fluids in upright vessels commonly called vertical shaft kilns or retorts. The distributors disclosed have a unique shape to facilitate movement of particulate matter passing by them and in addition have orifices which are recessed to keep each orifice free of solids with varying sized orifices as needed to provide the flow distribution uniformly across the lateral extent of the retort. Further the distributors are supported at each end by and protrude through nozzles built into the vessel shell to supply connection for external piping. The supports are so formed as to provide for thermal expansion through fluid-tight closures during high temperature operation.

14 Claims, 2 Drawing Sheets

RETORT FLUID DISTRIBUTOR

BACKGROUND OF THE INVENTION

The present invention relates to improvements in apparatus designs used in upright vessels commonly called vertical shaft kilns (retorts) and particularly to apparatus to properly and uniformly distribute fluid therein.

Shaft kiln type of retorts are used in a number of industrial applications requiring the distribution of hot treatment fluids uniformly across the lateral extent of such units.

In one type of vertical treatment vessel, particulate material to be treated is fed into the top of the vessel and by releasing processed material from the bottom of the vessel the material is made to flow as a moving bed through the vessel in a gravity flow. Treatment fluid may be injected into various portions of the downwardly moving bed of material for contacting the particulate matter.

In various types of kilns, crushed material of a variety of sizes is treated with hot gases either formed by heating internally of the bed of material or by heating externally of the kiln and the hot gases are injected into the bed of material.

In all vertical vessels, including kilns, it is desirable and mandatory that all of the material in the kiln be subjected uniformly to the influence of the treating fluids.

It has been very difficult in the prior art to have a distribution system which will distribute the fluid uniformly across the lateral extent of the retort while offering minimum resistance and disturbance to the flow of solids through the retort.

Further, it is difficult to provide distribution apparatus which will provide the necessary distribution of fluids to enhance the thermal efficiency of the retort operation and yet which is easy to maintain or replace.

In the present system, in general, one or more distributor assemblies are used in retorts and the like wherein the solids gravity flow through the different reaction zones. The distributors are placed in retort vessels to uniformly distribute fluids into the broken solids to accomplish selected thermal and/or chemical reactions. Such reactions may be the drawing, gasification and/or the pyrolysis of coal, oil shale and the like. Multiple distributors are used to inject fluids uniformly across the extent of the solids bed as it moves through the retort vessel.

The present invention uses either one or a multiple of fluid distributors per level and one or more levels in a single vessel. In operational practice, the distributors are used to inject process fluids into beds of the moving solids to effect selected thermal treatment and/or chemical reactions.

The distributors each have a horizontal plenum formed by a protective metal shell. Fluids may enter the plenum at either or both ends and have unrestricted flow communication therethrough between the distributor ends. The distributors are supported at each end by, and protrude through, nozzles built into the vessel shell therefore supplying connections for external piping. Packing glands are provided at each end of the distributors to provide for their thermal expansion during high temperature operation.

The present invention contemplates full size distributors which are placed inside the retort on chords. Each has a rectangular channel with parallel vertical walls forming the lower portion of at least a length of the plenum, wall members having an inverted V-shape forming the upper portion of the plenum, the outer ends of the wall members being in vertical alignment with the vertical sides of the lower rectangular channel, L-shaped members slope inwardly to connect each wall member of the inverted V-shaped upper portion to the top of each vertical side forming the rectangular lower portion, the end of one leg of one of the L-shaped members being attached to a corresponding one of the inverted V-shaped wall members and the end of the other leg of one of the L-shaped members being attached to the top of the corresponding one of the vertical sides. Multiple orifices are formed in the leg of the L-shaped member attached to each of the wall members for coupling the interior of the plenum to the interior of the vessel for the distribution of fluid from the plenum to the vessel interior. These orifices control the fluids entry into the solids bed in the vessel. Each row of the orifices is recessed beneath the distributor inverted V upper portion to keep the orifices free of solids. The orifices are pointed downwardly at an angle to the distributor horizontal axis to provide better fluid distribution in the bed of solids. A half-section distributor is provided for the side walls of the vessel and utilizes a half inverted V-shaped upper portion and a half shape rectangular lower portion. Thus, the half-section distributor is a full sized distributor that is divided about the vertical axis.

Divergent nozzle type orifices with a larger outlet than inlet are used to minimize the fluid's pressure loss on flowing therethrough. Furthermore, the outlet dimension of each nozzle is sufficiently large to permit the smaller inlet dimension to be the flow controlling orifice. The plenum is designed for low pressure drop per unit length for fluid flow therethrough which simulates a plenum of infinite capacity thereby providing uniform fluid mass flow to each of the orifices. Therefore, in the present invention, the smaller orifice controls the injection of fluids into the bed solids. Thus the orifice sizes may be varied as needed to provide flow distribution uniformly across the lateral extent of the retort. The orifices may be either circular or slot type. The orifices are pointed downwardly under the inverted V to keep the solids, which flow around the distributor, from obstructing the orifices and to provide maximum penetration of the fluid into the solids bed.

Thus it is an object of the present invention to provide an improved fluid distributor for upright vessels commonly called vertical shaft kilns or retorts.

It is a further object of the present invention to provide improved distributors for kilns which properly and uniformly distribute fluid therein.

It is also an object of the present invention to provide an improved distributor which has, in crosssection, a larger vertical axis than horizontal axis.

It is still another object of the present invention to provide a distributor having a plurality of orifices of a size to provide fluid flow distribution uniformly across the elongated length of the distributor.

It is yet another object of the present invention to provide a distributor wherein the size of each orifice is selected to provide uniform mass fluid flow to all sections of the retort cross-section with the size of each orifice being designed to serve a selected retort cross-section and the orifice size compensating for changes in viscosity and density as the fluid flows along the inside axis of the distributor for fluid flow therethrough to simulate a plenum of infinite capacity thereby providing uniform fluid mass flow to all portions of the reaction zone in the retort bed of solids served by the distributor.

It is still another object of the present invention to provide supports in the wall of the vessel to retain each end of the distributor with means on each end of the distributor for engaging the wall support means so as to provide for thermal expansion during high temperature operation and also provide easy access and removal for maintenance or replacement.

SUMMARY OF THE INVENTION

Thus, in apparatus for treating particulate matter in a hollow vessel with a fluid distribution system including at least one fluid distributor, it is an object of the present invention to provide an improved fluid distributor comprising an elongated plenum having a length sufficient to pass through and extend beyond the walls of the vessel, a rectangular channel having parallel vertical walls forming a lower portion of at least a length of the plenum, wall members having an inverted V-shape forming the upper portion of the plenum, the outer ends of the wall members being in vertical alignment with the vertical sides of the lower rectangular channel, L-shaped members sloped inwardly to connect each wall member of the inverted V-shaped upper portion to the top of each vertical side forming the rectangular lower portion, the end of one leg of one of the L-shaped members being attached to the inner side of a corresponding one of the inverted V-shaped wall members and the end of the other leg of said one of the L-shaped members being attached to the top of a corresponding one of the vertical sides and a plurality of orifices in the leg of the L-shaped member attached to each of the wall members for coupling the interior of the plenum to the interior of the vessel for distribution of fluid from the plenum to the vessel interior.

It is also an object of the invention to provide, in a method for treating particulate matter in a hollow vessel with a fluid in a fluid distribution system including at least one fluid distributor, an improved method of distributing the fluid comprising the steps of forming an elongated plenum having a length sufficient to pass through and extend beyond the walls of the vessel, forming the lower portion of at least a length of the plenum as a rectangular channel having parallel vertical walls, forming the upper portion of the plenum of wall members having an inverted V-shape, the outer ends of the wall members being in vertical alignment with the vertical sides of the lower rectangular channel, connecting each wall member of the inverted V-shaped upper portion to the top of each vertical side forming the rectangular lower portion with L-shaped members sloped inwardly, the end of one leg of one of the L-shaped members being attached to the inner side of a corresponding one of the inverted V-shaped wall members and the end of the other leg of said one of the L-shaped members being attached to the top of a corresponding one of the vertical sides, and forming a plurality of orifices in the leg of the L-shaped member attached to each of the wall members for coupling the interior of the plenum to interior of the vessel for distribution of fluid from the plenum to the vessel interior.

A BRIEF DESCRIPTION OF THE DRAWINGS

These and other objects of the present invention will be more fully disclosed in conjunction with the accompanying drawings in which like numerals represent like components and in which;

FIG. 4 is side view of the distributors shown in FIG. 2;

DETAILED DESCRIPTION OF THE DRAWINGS

Figure 1:
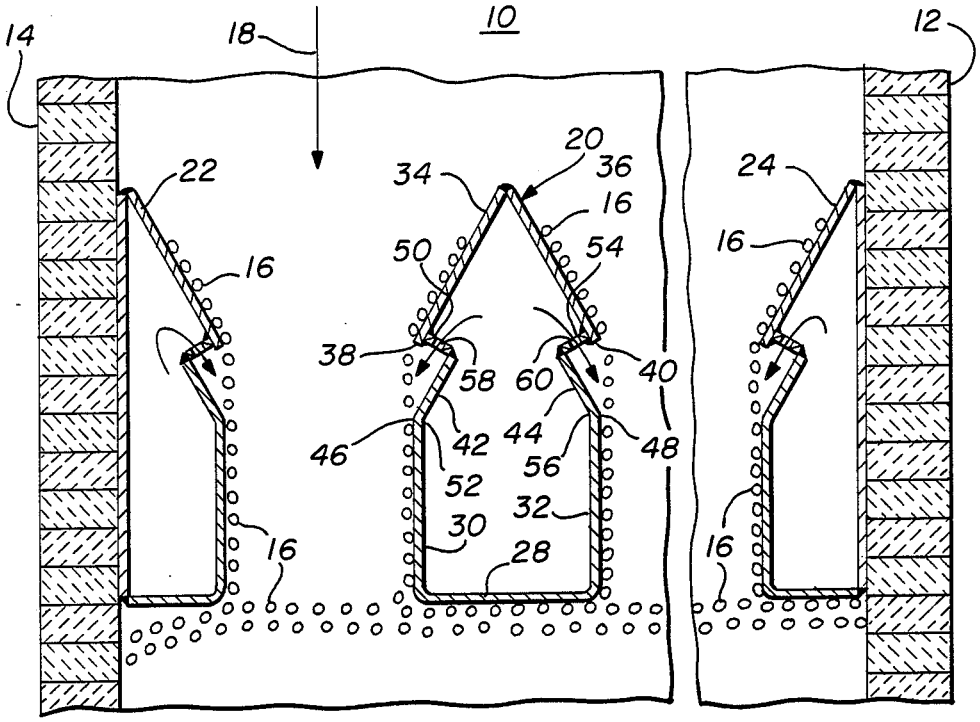
FIG. 1 is a partial cross-sectional view of a kiln or retort illustrating a cross-sectional view of the distributors therein.

FIG. 1 is a partial cross-sectional view of a retort vessel 10 illustrating outer walls 12 and 14 in which solid material 16 gravity flows downwardly in the direction of arrow 18 through the retort 10. A full distributor 20 and half-section distributors 22 and 24 are shown in the retort vessel 10 in spaced relationship to uniformly distribute fluid into the therein contained bed of broken solids 16 to accomplish selected thermal and/or chemical reactions. Such reactions may be the drying, gasification and/or the pyrolysis of coal, oil shale and the like. While only one full distributor 20 is shown, multiple distributors may be used with the distance between the center lines of adjacent distributors being that required for good fluid distribution in the bed of solids. Thus, the distributors inject fluids uniformly across the lateral extent of the solids bed as the solids 16 move through the retort vessel 10.

Figure 5:
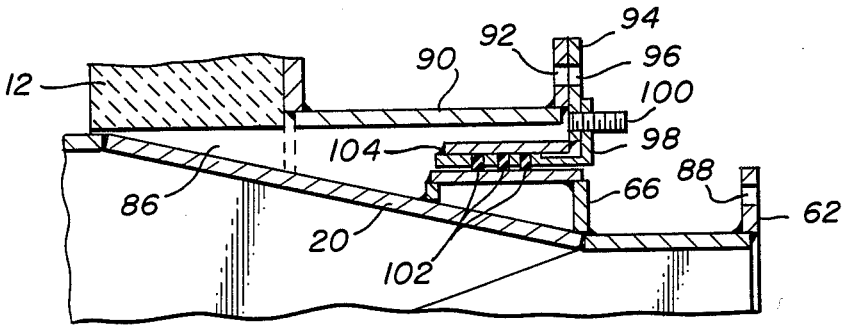
FIG. 5 is an enlarged view of a portion of the distributor in FIG. 4 illustrating the manner in which it is mounted in the vessel wall for easy maintenance and replacement.

While only one level and only one full distributor 20 is shown in that level in FIG. 10, the present invention uses either one or a multiple of distributors per level and one or more levels within a single vessel. In operational practice, distributors are used to inject the process fluids into the beds of solids to effect selected thermal treatment and/or chemical reactions. The full distributor 20 comprises an elongated plenum 26, shown in FIG. 2 and FIG. 4, having a length sufficient to pass through and extend beyond the wall 12 and 14 of the vessel 10 as illustrated in FIG. 5. The lower portion 28 of the plenum is formed as a rectangular channel having parallel vertical walls 30 and 32 extending at least a portion of the length of the plenum. The upper portion of the plenum is a cap formed by wall members 34 and 36 having an inverted V-shape. The outer ends 38 and 40 of the wall members 34 and 36 are in vertical alignment with the vertical sides 30 and 32 of the lower rectangular channel 28. L-shaped members 42 and 44 slope inwardly to connect each wall member 34 and 36 of the inverted V-shaped upper portion 34 to the tops 46 and 48 of the vertical sides 30 and 32 forming the rectangular lower portion 28. The end of one leg 50 of one of the L-shaped legs 42 is attached to the inner side of inverted V-shaped wall member 34 and the end 52 of the other leg of L-shaped member 42 is attached to the top 46 of vertical side 30.

In like manner, the end 54 of one leg of L-shaped member 44 is attached to the inner side of the inverted V-shaped wall member 36 and the end 56 of the other leg of L-shaped member 44 is attached to the top 48 of the vertical side 32. The plurality of orifices 58 and 60 are formed in the leg of L-shaped members 42 and 44 attached to each of the wall members 34 and 36 to couple the interior of the plenum 20 to the interior of the vessel 10 for distribution of fluid from plenum 20 to the vessel 10 interior. It will be seen in FIG. 1 that the distributor 20, in cross-section, has a longer vertical axis than horizontal axis.

Figure 2:
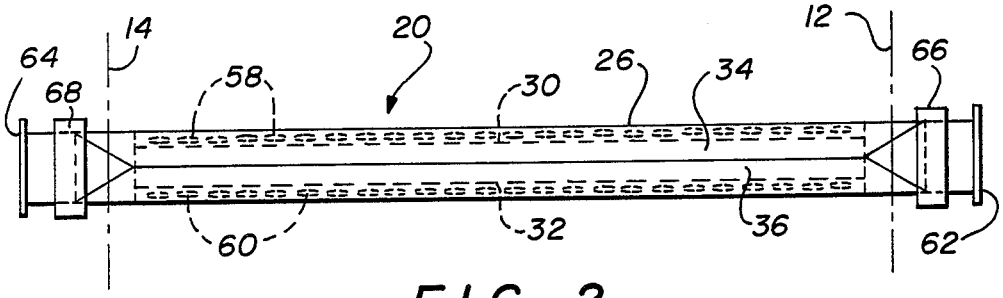
FIG. 2 is a top view of one of the distributors used in the kiln as shown in FIG. 1.

A top view of plenum or distributor 20 is shown in FIG. 2. As can be seen in FIG. 2, the plenum 20 is elongated and has a length sufficient to pass through and extend beyond the walls 12 and 14 of the vessel 10. Vertical side walls 30 and 32 are in vertical alignment with the outer ends 38 and 40 of the walls 34 and 36 of the inverted V-shaped upper portion of plenum 20. Orifices 58 and 60 may be either circular-shaped or slot-shaped. Flanges 62 and 64 are formed on each end of the plenum 20 for mounting. Also, a mounting bracket 66 and 68 is formed on each end of the plenum to provide for slideable mating contact with mounting brackets on the walls of the vessel 10 to provide for support as well as thermal expansion of the plenum during high temperature operation as will be seen in relation to FIG. 5.

Figure 3:
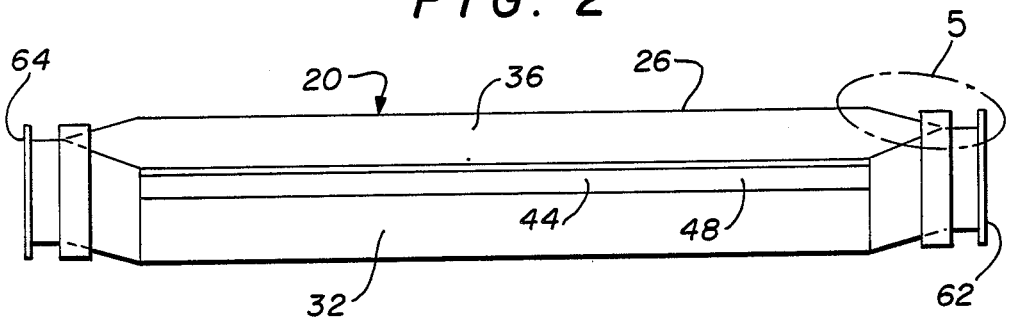
FIG. 3 is a partial view of the orifices in the distributor illustrating the increasing size of the orifices at a progressive distance along the length of the distributor.
Figure 3:
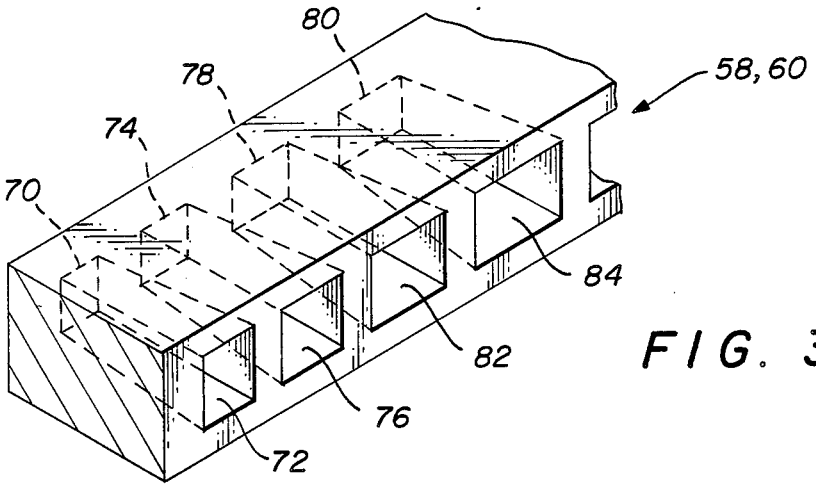

FIG. 3 is an illustration of slot-type orifices which are of the divergent nozzle type in which orifice sizes are varied to have an increasingly larger size in the direction of flow through the plenum in order to provide flow distribution uniformly across the lateral extent of the retort 10. Thus either of the orifices 58 or 60 in FIG. 2 and FIG. 1 may be represented in FIG. 3. It will be noted in FIG. 3 that the inlet orifice 70 is smaller than the divergent exit orifice 72. In addition, inlet orifice 74 which succeeds inlet orifice 70 is larger than inlet orifice 70 and also has a divergent outlet nozzle 76 which is larger than input nozzle 74. In like manner, succeeding nozzles 78 and 80 are each larger than the preceding one and each has a divergent output nozzle 82 and 84 respectively which is larger than the input nozzle. This variation can be continued the entire length of the plenum 20 or varied in such other manner as necessary so as to provide uniform flow distribution across the entire lateral extent of retort 10.

FIG. 4 is a side view of the plenum 20 shown in FIG. 3.

The particular mounting arrangement of the plenum on the walls of retort 10 is illustrated in FIG. 5. As can be seen in FIG. 5, the end of the plenum 20 is inserted through an orifice 86 in wall 12 of retort 10. The outer flange 62 of plenum 20 has holes 88 therein to which another conduit can be attached to either receive fluid from or supply fluid to the interior of plenum 20. Mounting base 66 is U-shaped and is rigidly attached as by welding to the outer periphery of plenum 20 as shown in FIG. 2 and FIG. 4. A first mounting bracket (FIG. 5) or nozzle 90 is attached to wall 12 of retort 10 and has plurality of holes 92 in a flanged portion thereof. A second mounting bracket 94 has an a plurality of holes 96 therein to enable it to be rigidly attached to the flange of mounting bracket or nozzle 90. A third bracket 98 or flanged follower has packing glands 102 therein to form a fluid-tight closure to accommodate the thermal expansion of plenum 20 during high temperature operation without fluid escaping. It is rigidly attached to bracket 94 by weld 104. Thus it will be seen in FIG. 5 that plenum 20 may move axially or laterally with respect to third bracket 98 to allow for expansion of plenum 20 with respect to the mounting brackets 90 and 94 which are attached to the wall 12 of retort 10.

Figure 6:
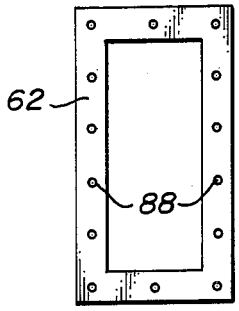
FIG. 6 is an end view of the distributor mounting plate to which a fluid supply may be connected.

FIG. 6 is an end view of flange 62 on the outer end of plenum 20 to which another conduit or tubing of some type may be attached to supply the fluid thereto.

Figure 7:
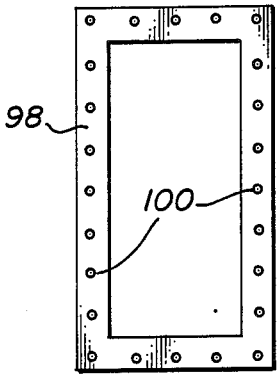
FIG. 7 is an end view of a coupler which may be used to mount the end of the distributor in a bracket attached to the vessel wall.
Figure 8:
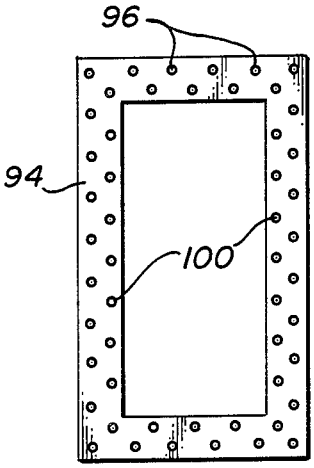
FIG. 8 is an end view of the bracket attached to the vessel wall to which the coupling plate of FIG. 7 is attached.

FIG. 7 is an end view of the flanged follower 98 shown in FIG. 5 which compresses the packing that provides the fluid-tight seal and allows for the thermal expansion of the plenum 20 by having flange 98 in FIG. 7 attached to flange 92 and 94 in FIG. 5. FIG. 8 illustrates flange 94 which has holes 96 and studs 100 therein.

Thus there has been described herein an improved distributor or plenum chamber for a retort wherein one or more of such distributor assemblies may be placed in a retort and wherein the solids gravity flow through and pass by the distributors. These distributors uniformly distribute fluids into the bed of broken solids to accomplish selected thermal and/or chemical reactions. These reactions may be the drying, gasification and/or pyrolysis of coal, oil shale and the like. Multiple distributors are used to uniformly inject fluid across the lateral extent of solids bed as it moves through the retort vessel. The distributor has, in a cross-section, a larger or longer vertical axis than horizontal axis for easy flow of material past the distributor. It also includes wall members having an inverted V-shape forming the upper portion of the distributor and the outer ends of the wall members are in vertical alignment with the vertical sides of a rectangular channel forming the lower portion of the distributor. A plurality of orifices are formed in an L-shaped member under the edge of the wall members forming the inverted V for coupling the interior of the distributor to the interior of the retort vessel to distribute fluids thereto. The outlet of each of the orifices is larger than the inlet and the size of each inlet orifice is selected to provide uniform mass flow to all sections fo the retort cross-section with such size of each orifice being designed to serve a selected retort cross-section and the orifice size compensating for changes in viscosity and density as the fluid flows along the inside axis of the distributor to simulate a distributor with infinite capacity to therefore provide uniform fluid mass flow to all portions of the reaction zone in the retort bed of solids served by the distributor. The orifices may be either circular shaped or slot shaped. The distributors are supported at each end by the walls of the retort so as to provide for thermal expansion during high temperature operation.

While the invention has been described in connection with a preferred embodiment, it is not intended to limit the scope of the invention to the particular form set forth, but, on the contrary, it is intended to cover such alternatives, modifications and equivalents as may be included within the spirit and scope of the invention defined by the appended claims.

I claim:

1. In a system for treating particulate matter in a hollow vessel with a fluid in a fluid distribution system including fluid distributors, an improved fluid distribution system comprising;

a. at least one elongated plenum having a length sufficient to be supported by the walls of said vessel, b. a rectangular channel having parallel vertical side walls forming the lower portion of at least a length of said plenum, c. wall members having an inverted V-shape forming the upper portion of said plenum, the outer ends of said wall members being in vertical alignment with said vertical sides of said lower rectangular channel, d. L-shaped members sloped inwardly to connect each wall member of said inverted V-shaped upper portion to the top of each vertical side forming said rectangular lower portion, the end of one leg of one of said L-shaped members being attached to the inner side of a corresponding one of said inverted V-shaped wall members and the end of the other leg of said one of said L-shaped members being attached to the top of the corresponding one of said vertical sides, and e. a plurality of orifices in said leg of said L-shaped member attached to each of said wall members for coupling the interior of said plenum to the interior of said vessel for distribution of fluid from said plenum to said vessel interior.

2. The improved distributor system of claim 1 wherein said distributor, in cross-section, has a longer vertical axis than horizontal axis.

3. The improved distributor of claim 2 further comprising said plurality of orifices being of varying sizes to provide fluid flow distribution uniformly into said vessel interior across the elongated length of said plenum.

4. The improved fluid distributor of claim 3 further comprising:

a. an inlet on each said orifices on the inside of said plenum, b. an outlet on each of said orifices on the outside of said plenum, said orifice inlet being smaller than said orifice outlet, and c. each orifice inlet being increasingly larger in size as the distance of the orifice from the fluid inlet end of said plennum increases to provide even fluid flow for each retort reaction zone by the orifice so as to simulate a plennum of infinite capacity thereby providing uniform fluid mass flow to each portion of said reaction zone.

5. The improved distributor of claim 4 wherein said orifices are circular-shaped.

6. The improved distributor of claim 4 wherein said orifices are slot-shaped.

7. The improved fluid distribution system of claim 1 further comprising:

a. means in said wall of said vessel for supporting each end of said distributor, and b. means on each end of said distributor for engaging said support means so as to provide for thermal expansion during high temperature operation.

8. In a method of treating particulate matter in a hollow vessel with a fluid in a fluid distribution system and including fluid distributors, an improved method of distributing said fluid comprising the steps of:

a. forming at least one elongated plenum having a length sufficient to be supported by the walls of said vessel, b. forming the lower portion of at least a length of said plenum with a rectangular channel having parallel vertical side walls, c. forming the upper portion of said plenum with wall members having an inverted V-shape, the outer ends of said wall members being in vertical alignment with said sides of said lower rectangular channel, d. connecting each wall member of said inverted V-shaped upper portion to the top of each vertical side forming said rectangular portion with L-shaped members sloped inwardly, the end of one leg of one of said L-shaped members being attached to the inner side of a corresponding one of said inverted V-shaped wall members and the end of the other leg of said one of said L-shaped members being attached to the top of the corresponding one of said vertical sides, and e. forming a plurality of orifices in said leg of said L-shaped member attached to each of said wall members for coupling the interior of said plenum to the interior of said vessel for distribution of fluid from said plenum to said vessel interior.

9. The method of claim 8 further including the step of forming said distributor, in cross-section, with a longer vertical axis than horizontal axis.

10. The improved method of claim 9 further comprising the step of varying the sizes of said plurality of orifices to provide fluid flow distribution uniformly into said vessel interior across the enlongated length of said plenum.

11. The improved method of claim 10 further comprising the steps of:

a. forming the outlet of each orifice on the outside of said plenum larger than the inlet of each orifice formed on the inside of said plenum, and b. forming each orifice inlet increasingly larger in size as the distance of the orifice from the fluid inlet end of said plenum increases to provide even fluid flow for each retort reaction zohe by the orifices so as to simulate a plenum of infinite capacity thereby providing uniform fluid mass flow to each portion of said reaction zone.

12. The improved method of claim 11 further comprising the step of forming said orifices in a circular shape.

13. The improved method of claim 11 further comprising the step of forming said orifices in a slot shape.

14. The improved method of claim 8 further including the steps of:

a. supporting each end of said disrributor in the walls of said vessel; and b. mounting means on each end of said distributor to be supported on said walls so as to provide for thermal expansion during high temperature operation.

* * * * *

UNITED STATES PATENT AND TRADEMARK OFFICE

CERTIFICATE OF CORRECTION

PATENT NO. : 4,738,617

DATED : April 19, 1988

INVENTOR(S) : Zimmerman

It is certified that error appears in the above-identified patent and that said Letters Patent are hereby corrected as shown below:

Column 8, line 46, (in Claim 11), "zohe" should read -- zone --.

Signed and Sealed this

Sixth Day of September, 1988

*Attest:*

DONALD J. QUIGG

*Attesting Officer*

*Commissioner of Patents and Trademarks*